US009345072B2

(12) United States Patent
Brosnan et al.

(10) Patent No.: US 9,345,072 B2
(45) Date of Patent: May 17, 2016

(54) INDUCTION COOKING ELECTROMAGNETIC INDUCED REJECTION METHODS

(75) Inventors: Daniel Vincent Brosnan, Louisville, KY (US); John L. Etheredge, Ooltewah, TN (US)

(73) Assignee: General Electric Company, Schenectady, NY (US)

( * ) Notice: Subject to any disclaimer, the term of this patent is extended or adjusted under 35 U.S.C. 154(b) by 953 days.

(21) Appl. No.: 13/348,102

(22) Filed: Jan. 11, 2012

(65) Prior Publication Data

US 2013/0175259 A1 Jul. 11, 2013

(51) Int. Cl.
*H05B 6/12* (2006.01)
*H05B 6/06* (2006.01)

(52) U.S. Cl.
CPC ..... *H05B 6/062* (2013.01)

(58) Field of Classification Search
CPC ..... G05B 13/02; G05B 19/0426; G05B 2219/31472; G05B 23/0286; G05D 23/19; G06F 3/048; G06F 1/3206; G06F 3/0484; G06F 3/044; G06F 3/045; G06F 11/3051; G06F 17/00; G01R 27/2605; G01R 27/2611; G01R 27/16; G01R 27/18; G06N 5/04; G06N 99/005; G06N 3/08; G06N 7/00; G06Q 50/12
USPC ..... 700/17, 18, 28–32, 83, 84, 264, 299, 700/300; 324/76.75, 691–693, 697; 706/20, 706/22, 25, 31, 45–48, 50–52, 61
See application file for complete search history.

(56) References Cited

U.S. PATENT DOCUMENTS 5,572,205 A * 11/1996 Caldwell ..... H03K 17/9622 200/600
5,900,175 A * 5/1999 Kicherer ..... H05B 3/748 219/447.1
6,236,024 B1 * 5/2001 Gotz ..... H05B 3/74 126/39 H
6,316,753 B2 * 11/2001 Clothier ..... G06K 7/0008 219/621
6,320,169 B1 * 11/2001 Clothier ..... G06K 7/0008 219/620
6,444,958 B1 * 9/2002 Campbell ..... F24C 15/101 126/21 R
6,809,301 B1 * 10/2004 McIntyre ..... F24C 7/082 219/492
7,051,802 B2 * 5/2006 Baer ..... H05K 7/20609 165/299
7,081,603 B2 * 7/2006 Hoh ..... F24C 15/101 219/443.1
7,085,619 B2 * 8/2006 Broese ..... G05B 13/042 700/108
7,102,109 B2 * 9/2006 Niiyama ..... H05B 6/062 219/494
7,174,720 B2 * 2/2007 Kennedy ..... A47J 27/004 62/3.3
7,423,244 B2 * 9/2008 Baier ..... H05B 6/062 219/624
7,518,381 B2 * 4/2009 Lamborghini ..... B60K 37/06 324/658
7,586,483 B2 * 9/2009 Tanabe ..... G02F 1/13338 345/173
7,687,748 B2 * 3/2010 Gagas ..... H05B 6/1263 126/21 A
7,777,624 B2 * 8/2010 Wu ..... G01S 13/56 340/554

(Continued)

*Primary Examiner* — Eric Stapleton
(74) *Attorney, Agent, or Firm* — Dority & Manning, P.A.

(57) ABSTRACT

An induction cooking system and method that prevents a valid key touch from being rejected is provided. A noise rejection apparatus can prevent noise from influencing the determination of a valid key touch.

7 Claims, 8 Drawing Sheets

(56) References Cited

U.S. PATENT DOCUMENTS 8,077,152 B2 * 12/2011 Wohlgenannt ..... G01R 33/09 324/244
8,321,174 B1 * 11/2012 Moyal ..... G06F 3/0416 702/150
8,358,142 B2 * 1/2013 Maharyta ..... G01R 27/2605 324/658
8,395,395 B2 * 3/2013 Bruwer ..... H03K 17/16 178/18.06
8,514,185 B2 * 8/2013 Hotelling ..... G06F 3/044 345/156
8,525,798 B2 * 9/2013 Peterson ..... G06F 3/0416 345/156
8,536,880 B2 * 9/2013 Philipp ..... G06F 3/03547 324/658
8,570,052 B1 * 10/2013 Mahartya ..... G01R 27/2605 324/658
8,570,305 B2 * 10/2013 Jorgensen ..... G06F 3/0416 345/178
8,576,182 B2 * 11/2013 Hristov ..... G06F 3/0416 178/18.02
8,614,690 B2 * 12/2013 Grunthaner ..... G06F 3/0418 178/18.06
8,743,060 B2 * 6/2014 Hotelling ..... G06F 3/0362 345/156
8,766,936 B2 * 7/2014 Kawalkar ..... G06F 3/04886 345/173
8,840,765 B2 * 9/2014 Offenbacher ..... G01N 33/4925 204/400
8,872,077 B2 * 10/2014 Gagas ..... H05B 6/1209 219/620
8,902,172 B2 * 12/2014 Peng ..... G06F 3/0416 345/173
2006/0007171 A1 * 1/2006 Burdi ..... H03K 17/962 345/173
2006/0214920 A1 * 9/2006 Hsieh ..... G06F 3/044 345/173
2006/0221061 A1 * 10/2006 Fry ..... G06F 3/0418 345/173
2007/0023420 A1 * 2/2007 Gagas ..... F24C 15/2042 219/623
2007/0169770 A1 * 7/2007 Kuwamura ..... F24C 15/108 126/211
2008/0136792 A1 * 6/2008 Peng ..... G06F 3/0416 345/174
2010/0163549 A1 * 7/2010 Gagas ..... H05B 6/1209 219/622
2012/0146935 A1 * 6/2012 Bulea ..... G06F 3/03547 345/174

* cited by examiner

INDUCTION COOKING ELECTROMAGNETIC INDUCED REJECTION METHODS

FIELD OF THE INVENTION

The present disclosure relates to induction cooking and more particularly to a system and method for preventing valid key touches from being rejected in an induction cooking system, such as a cooktop.

BACKGROUND OF THE INVENTION

Induction cooktops are preferred over conventional cooktops because they are more efficient, have greater temperature control precision including very low temperature settings and cook food more evenly. In conventional cooktop systems, a heat source, such as an electric element or gas burner, is used to heat the cookware in contact with the heat source. This type of cooking system is inefficient because only the portion of the cookware in contact with the heat source is directly heated and the rest of the cooking utensil (e.g. pot or pan) is heated through conduction. This causes non-uniform heating throughout the cooking utensil and takes longer to reach a desired temperature needed for adequate cooking.

In contrast, induction cooking systems use electromagnetism to turn the cooking utensil into the heat source. A power inverter supplies an alternating current (A/C) having a predetermined frequency to the induction coil. The A/C causes a fluctuating magnetic field which induces a current on the bottom surface of the cooking utensil. The induced current on the bottom surface then induces even smaller currents (eddy currents) within the cooking utensil thereby producing heat throughout the cookware. In general, the frequency of the current remains uniform from the power inverter, to the coil, to the current induced on the bottom of the pan and finally to the current induced within the pan.

Integrated touch-key user interfaces may be used in an induction cooking system. For example, the integrated touch-key user interface may be a capacitive glass touch screen, an inductive touch screen, a resistive touch screen or an LCD touch screen. When a capacitive glass touch screen is used, a conductive input (e.g., human touch) must be used in order to be detected as a valid key touch. When a user touches the screen, electric charge is transferred from the user to the screen and the charge on the capacitive layer decreases. This decrease in capacitance on the layer may be how a controller detects a valid key touch.

However, when the user is touching the cooking utensil and pushes a key on the capacitive user interface, a noisy, distorted high frequency signal equal to that of the inverter drive for the cooking coil is detected and interpreted as an invalid key touch because the signal frequency is much faster than a human can press in a given interval. As shown in FIG. 1A, when a user touches a key on a user interface without the influence of a noisy, distorted high frequency signal, one key press is detected in one second and it is considered a valid key press. The appliance then may respond according to the valid key press. Alternatively, as shown in FIG. 1B, when a user touches a key on the user interface while touching the cooking utensil, the noisy, distorted high frequency signal is conducted and detected by the user interface. The user interface then detects a key press for each frequency peak of the signal. For clarity purposes FIG. 1B illustrates 10 key presses within a one second interval, however in reality the number of presses is directly related to the frequency of the inverter. More specifically, approximately 20-50 thousand presses may be detected within a one second interval because the frequency of the inverter is generally between 20-50 KHz. Because it is impossible for a human to activate a valid key press that quickly, the key press is rejected and the user interface continues to wait for an acceptable key press.

In view of these known concerns, it would be advantageous to provide an induction cooktop system with the capability to detect a valid key touch when noise is introduced into the system.

BRIEF DESCRIPTION OF THE INVENTION

Aspects and advantages of the invention will be set forth in part in the following description, may be obvious from the description, or may be learned through practice of the invention.

The present subject matter relates to an induction cooking system including an induction heating coil disposed in a chassis of the induction cooking system and an inverter coupled with the coil. The inverter supplies energy to the coil. The cooking system further includes a cooking utensil that may be energized by the coil and the cooking utensil produces an electromagnetic induced signal having noise when energized. A user interface may be in communication with the coil and the inverter. The user interface includes an input key to receive a first key touch. A conductor that conducts the electromagnetic induced signal having noise between the energized cooking utensil and the user interface is provided. A noise rejection apparatus that prevents rejection of a valid key touch signal is provided. The noise rejection apparatus includes a controller that determines the valid key touch, and a feedback loop in communication with the controller. The controller compares a signal from the feedback loop and the first key touch to determine the valid key touch.

In another exemplary embodiment, the present invention provides an induction cooking system including an induction heating coil disposed in a chassis of the induction cooking system and an inverter coupled to the coil. The inverter supplies energy to the coil. A user interface is in communication with the coil and the inverter and includes an input key to receive a first key touch. A glass surface adjacent to the induction heating coil or the user interface and a noise rejection apparatus that prevents rejection of a valid key touch signal. The noise rejection apparatus includes a conductive material disposed on the glass surface.

In still another exemplary embodiment, the present invention provides a method of determining a valid key touch in an induction cooking system that includes supplying energy to an induction heating coil, energizing the induction heating coil to generate an electromagnetic induced signal having noise, conducting the electromagnetic induced signal having noise to a user interface, detecting a first key touch including the electromagnetic induced signal having noise at the user interface and determining whether the first key touch is a valid key touch.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
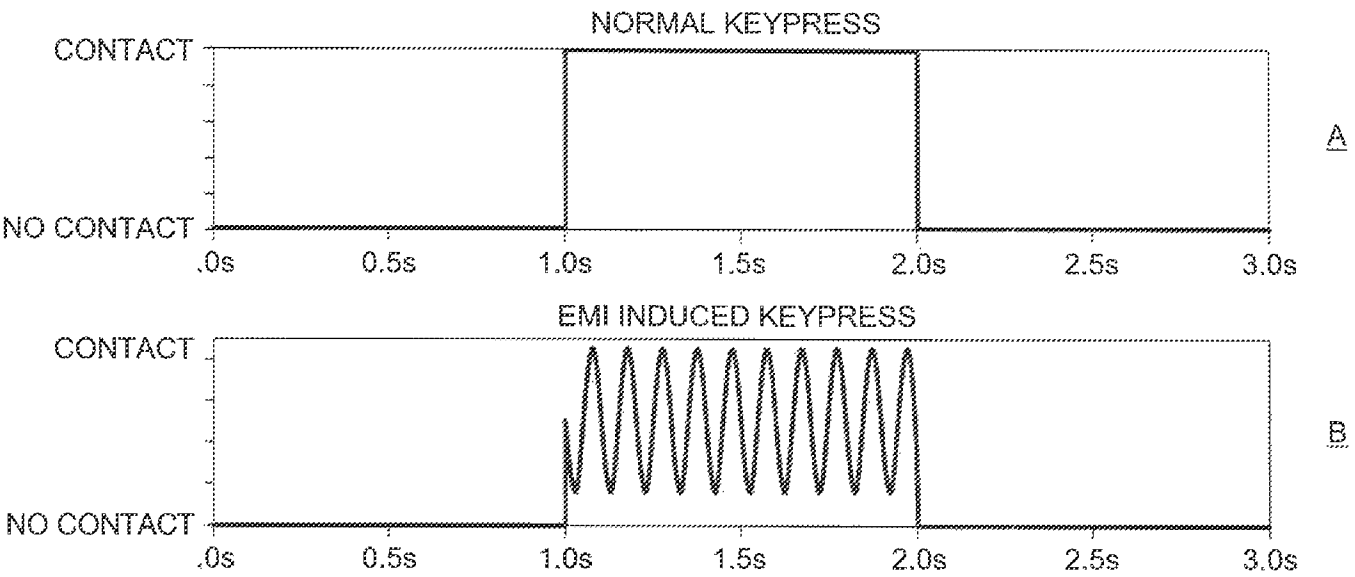
FIGS. 1A and 1B provides waveforms of key touches as seen by a user interface.

The present invention relates to an induction cooking system and method that prevents a valid key touch from being rejected. A noise rejection apparatus can prevent noise from influencing the determination of a valid key touch.

Reference now will be made in detail to embodiments of the invention, one or more examples of which are illustrated in the drawings. Each example is provided by way of explanation of the invention, not a limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
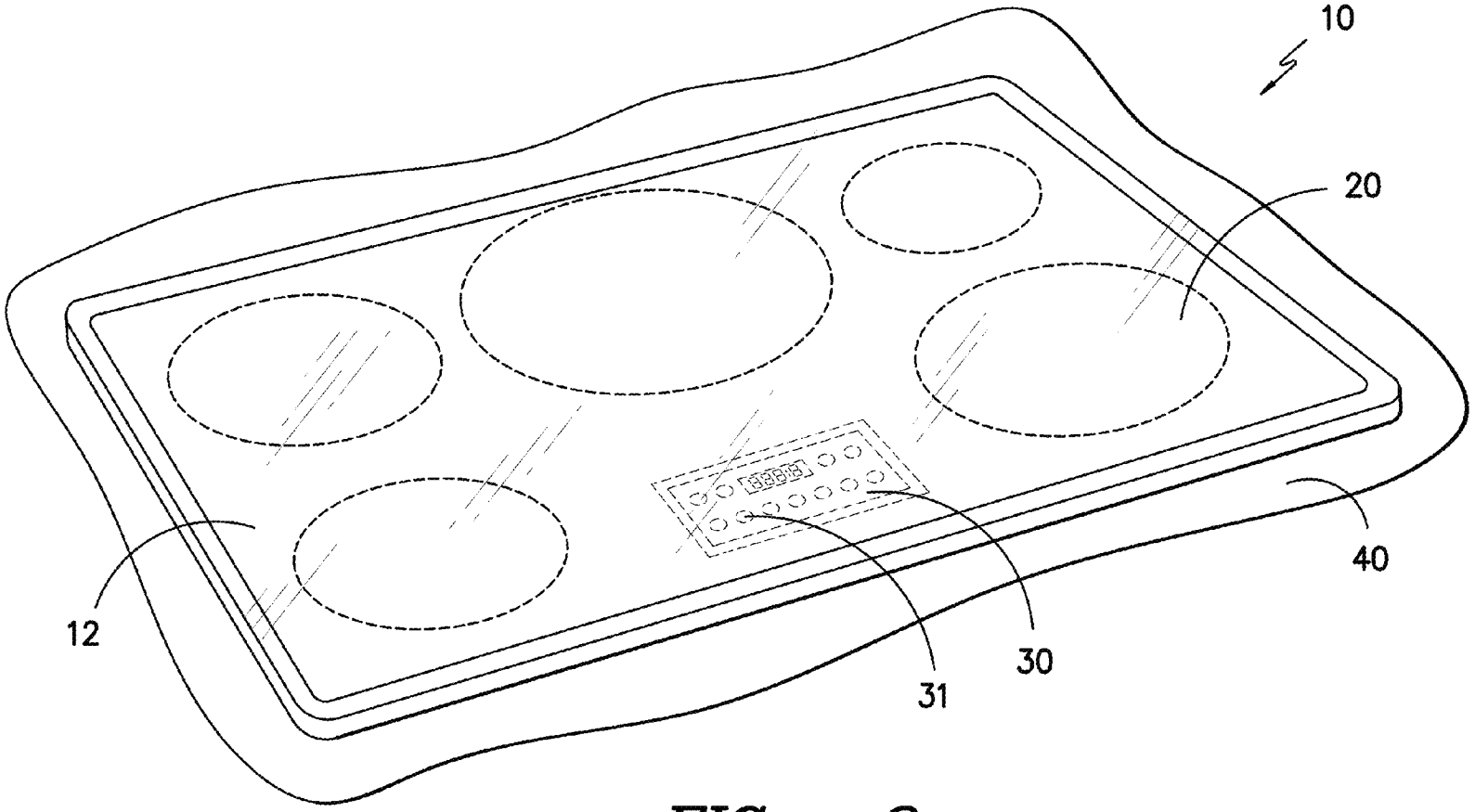
FIG. 2 provides a top, perspective view of an exemplary induction cooking system of the present disclosure.

FIG. 2 provides an exemplary embodiment of an induction cooktop appliance 10 of the present invention. Cooktop 10 may be installed in a chassis 40 and in various configurations such as in cabinetry in a kitchen, coupled with one or more ovens or as a stand-alone appliance. Chassis 40 may be grounded. Cooktop 10 includes a horizontal surface 12 that may be glass. Induction coil 20 may be provided below horizontal surface 12. It may be understood that cooktop 10 may include a single induction coil or a plurality of induction coils.

Cooktop 10 is provided by way of example only. The present invention may be used with other configurations. For example, a cooktop having one or more induction coils in combination with one or more electric or gas burner assemblies. In addition, the present invention may also be used with a cooktop having a different number and/or positions of burners.

A user interface 30 may have various configurations and controls may be mounted in other configurations and locations other than as shown in FIG. 2. In the illustrated embodiment, the user interface 30 may be located within a portion of the horizontal surface 30, as shown. Alternatively, the user interface may be positioned on a vertical surface near a front side of the cooktop 10 or anywhere a user may locate during operation of the cooktop. The user interface 30 may include a capacitive touch screen input device component 31. The input component 31 may allow for the selective activation, adjustment or control of any or all induction coils 20 as well as any timer features or other user adjustable inputs. One or more of a variety of electrical, mechanical or electro-mechanical input devices including rotary dials, push buttons, and touch pads may also be used singularly or in combination with the capacitive touch screen input device component 31. The user interface 30 may include a display component, such as a digital or analog display device designed to provide operational feedback to a user.

Figure 3:
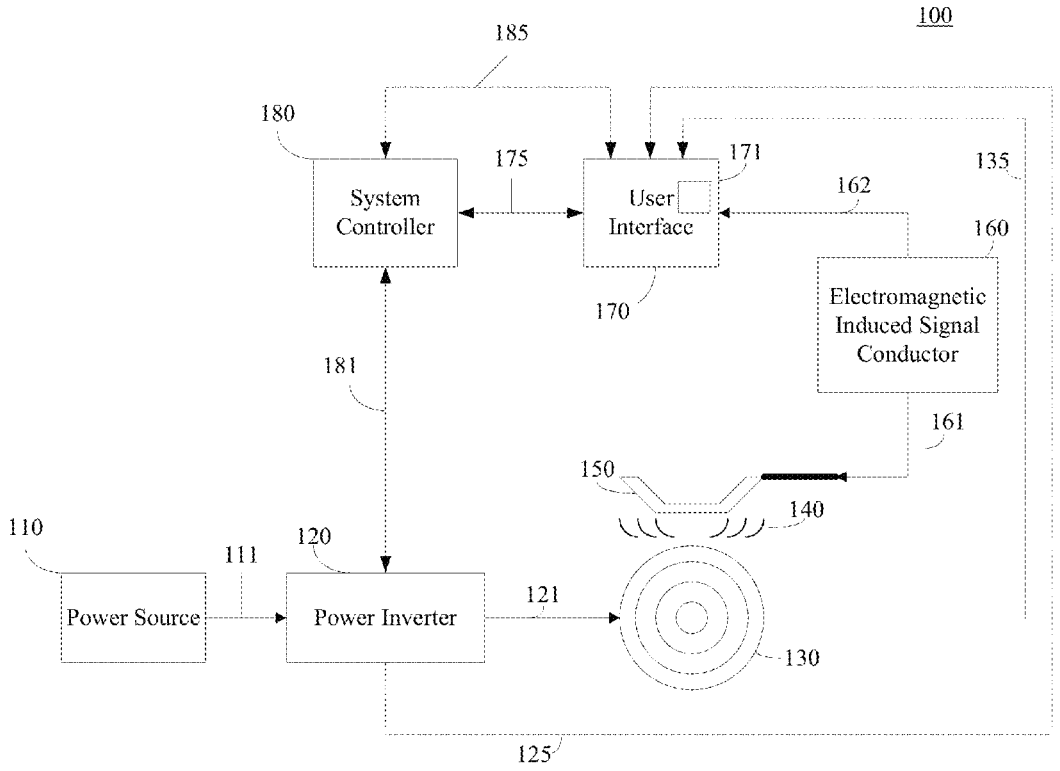
FIG. 3 provides a diagram of an exemplary induction cooking system of the present invention.

With reference now to FIG. 3, there is illustrated a schematic block diagram of a portion of an induction cooking appliance system 100. System may include a power source 110 configured to supply power to a power inverter 120 via a power source line 111. Power source 110 may supply 240V of alternating current (A/C) to the power inverter 120. Power inverter 120 may be configured to supply operating power to an induction cooking coil 130 via an output line 121 from the inverter 120. In an exemplary configuration, power inverter 120 may operate as a high frequency, high current power source for coil 130. For example, the operating frequency for the inverter may be in the range of 20-50 KHz.

As will be understood by those of ordinary skill in the art, when power is supplied to coil 130 from power inverter 120, a magnetic field 140 is produced and may be coupled to a cooking utensil 150 through, for example, a glass support surface 12 thereby creating eddy currents in the utensil 150 that will heat the utensil. The magnetic field 140 coupled to the utensil 150 may be influenced by various factors, such as the utensil's size or shape, placement relative to the coil and the coil's size and shape, as well as the material of the coil and/or utensil.

Operation of the induction cooking system may be regulated by a system controller 180 which is operatively coupled to a user interface panel 170 through a control connection line 175. The user interface 170 may have an input for user manipulation to select burner, level of cooking, etc. In response to user manipulation of the user interface input 170, the system controller 180 may operate the various components of the induction cooking system and execute user selected inputs.

The controller 180 may include a memory and microprocessor, CPU or the like, such as a general or special purpose microprocessor operable to execute programming instructions or micro-control code associated with an induction cooking system. The memory may represent random access memory such as DRAM, or read only memory such as ROM or FLASH. In one embodiment, the processor executes programming instructions stored in memory. The memory may be a separate component from the processor or may be included onboard within the processor.

When a user selects an input on the user interface 170 to activate a coil 130, a signal may be sent over the control connection line 175 to the system controller 180. The controller 180 initiates the power inverter 120 by sending a signal over the power inverter control line 181. This signal may include information on what power should be supplied to the power inverter 120. For example, signal characteristics of current, voltage, frequency, and noise may be communicated.

A signal to activate coil 130 may be sent over output line 121 from the power inverter 120. This signal may include the same or different characteristics as the signal sent from the controller 180. After the coil 130 is activated, an electromagnetic induced field 140 may be created and may include similar signal characteristics as that of the power inverter 120 and/or the controller 180. The electromagnetic induced field 140 may induce a current on the bottom of the cooking utensil 150 and smaller eddy currents within the cooking utensil 150.

When a user comes in contact with the cooking utensil 150, the human body may act as an electromagnetic induced signal conductor 160. When the user also comes in contact with the user interface 170 when selecting a key, an electromagnetic induced signal is conducted between the cooking utensil 150 and the user interface 170. The user interface 170 may determine that an invalid key touch has been actuated because the electromagnetic induced signal has a noise and frequency different from the expected key touch from a user. In order to prevent a rejection of this key touch, the present invention may use feedback loops to determine a valid key touch.

Power inverter feedback loop 125, system controller feedback loop 185 and coil feedback loop 135 may all be in communication with the user interface 170 and more specifically the feedback loops may be in communication with user interface controller 171. In addition, the signal conducted from the cooking utensil 150 to the user interface 170 may be considered an electromagnetic induced signal conductor feedback loop 161,162. Signals from any or all of feedback loops 125, 185, 135, 161 and 162 may be used by the user interface controller 171 to determine a valid key touch.

Figure 4:
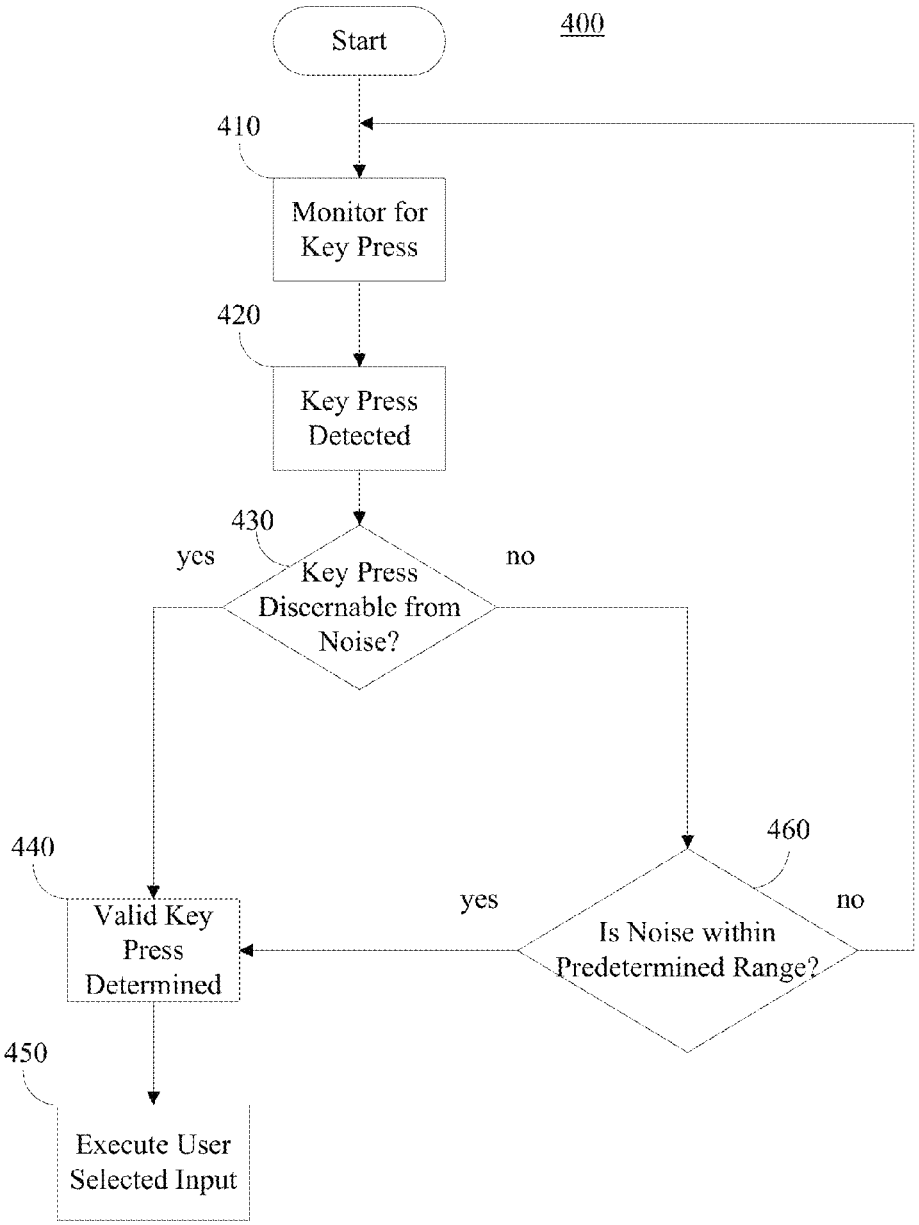
FIG. 4 provides a flow chart of a method for determining a valid key touch according to an exemplary embodiment of the present disclosure.

With reference now to FIG. 4, flowchart 400 may describe how the user interface controller determines a valid key touch. At step 410, the controller may continuously monitor for a key press to be detected. When a key press is detected in step 420, controller may then determine in step 430 if it was a known key press or if it contained noise, such as an electromagnetic induced signal having noise, outside the range of a known key press. If the key press is determined to be within a known range in step 440, then the user interface controller determines that it is a valid key press and sends signals to the controller to execute the user selected input in step 450. However, if the controller cannot discern a key press from a noise filled signal, the controller carries out step 460, to determine if the noise is within a predetermined range.

For example, the system controller has a known signal and that signal is represented to the user interface controller through feedback loop 185. Power inverter and coil also have signals that are represented to the interface controller through feedback loops 125 and 135, respectively. All of these signals may be similar or slightly different based on normal loss through the system. The user interface controller may compare one or all of these signals to the signal received through the electromagnetic induced conductor. When the electromagnetic induced signal with noise has similar noise frequencies as that of the signal received through feedback loops 125, 135 and 185, then the user interface controller may determine that the electromagnetic induced signal with noise is within a predetermined range. When the electromagnetic induced signal with noise is within the predetermined frequency range, the user interface controller may determine that it is a valid key press and sends signals to the controller to execute the user selected input in step 450. If the noise in the signal does not fall within the predetermined range, the user interface controller determines that it is not a valid key press and returns to monitoring for a key press as in step 410.

Figure 5:
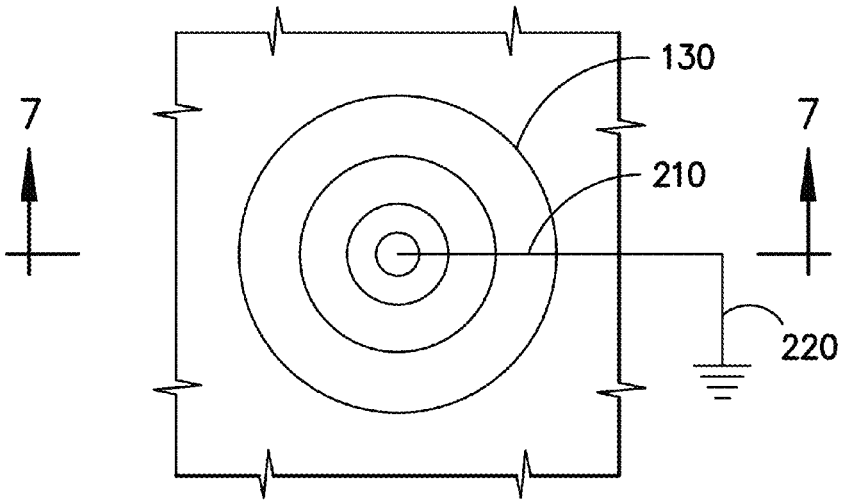
FIG. 5 provides a top, perspective view of a noise reduction configuration with an induction coil.
Figure 7:
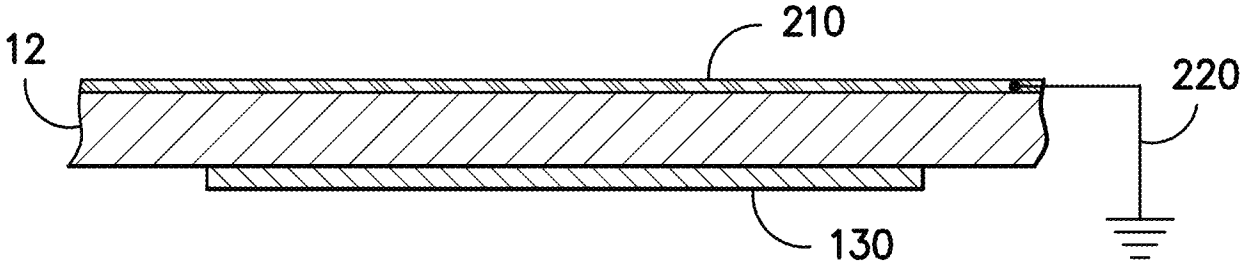
FIG. 7 provides a cut-away side view of a noise reduction configuration with an induction coil.

In an alternative embodiment illustrated in FIGS. 5 and 7, noise from an electromagnetic induced signal may be prevented from being conducted to the user interface by using a conductive material 210. For example, a conductive material 210 is disposed adjacent the coil and the horizontal surface 12. The conductive material 210 may have a variety of shapes or thicknesses including a plurality of shapes and/or thicknesses corresponding to a single coil or a plurality of coils. When a cooking utensil is placed on the horizontal surface 12, it may come in contact with the conductive material 210. An electromagnetic field may be induced by the coil 130 and the cooking utensil is energized as previously described. The conductive material may be connected to ground 220 and because ground is at a lower voltage, the electromagnetic induced signal including noise may be conducted to ground rather than to the user interface. The conductive material may be any material capable of conducting the electromagnetic induced signal with noise such as a transparent conductive material or a metal.

Figure 6:
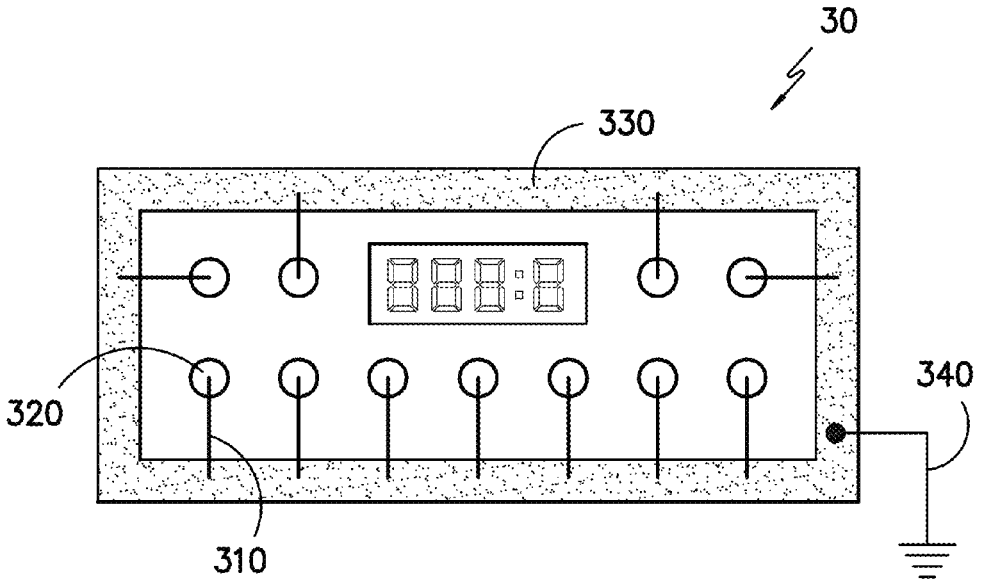
FIG. 6 provides a front view of a noise reduction configuration with a user interface.

FIG. 6 illustrates still another alternative embodiment, where conductive material 310 is disposed adjacent to keys 320 on a user interface panel 30 that may be glass. The user interface may include a panel frame 330 that may be a conductive metal or it may be a dielectric material. Conductive material 310 may be disposed on the user interface panel 30 which may be located adjacent the keys 320 of the user interface panel 30. The conductive material 310 may have a variety of shapes or thicknesses including a plurality of shapes and/or thicknesses corresponding to a single key or a plurality of keys. The panel frame 330 may be connected to ground 340 and the conductive material 310 may be connected to the panel frame 330.

For example, when an electromagnetic induced signal is generated on a cooking utensil as described above, the electromagnetic induced signal with noise is conducted from the cooking utensil to the user interface. Alternatively, when the user comes in contact with the conductive material 310, the signal may be grounded before reaching the capacitive user touch screen. Thus, a valid key press is received at the user interface key and the controller may send a signal to execute the user selected input.

Any or all of the above illustrations may be used singularly or in combination. For example, the conductive material may be deposited on both the cooktop horizontal surface and the user interface surface. Alternatively, one or both of the conductive material embodiments may be used in combination with the valid key touch processing method.

It should also be appreciated that the present invention encompasses any manner of induction cook top 10 (FIG. 2) or induction cooktop system 100 (FIG. 3) that incorporates operating features as discussed above.

Figure 8:
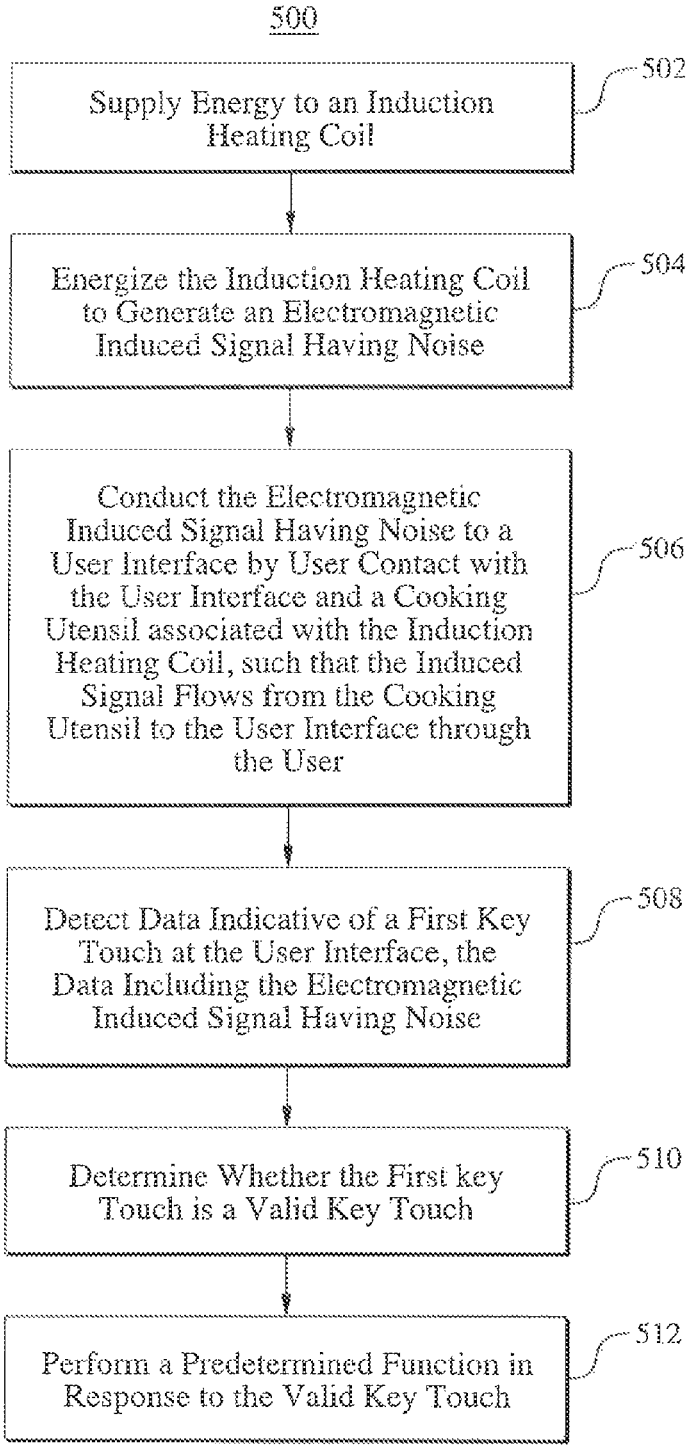
FIG. 8 provides a flow chart of a method for determining a valid key touch in an induction cooking system according to an exemplary embodiment of the present disclosure.

FIG. 8 depicts a flow chart of a method 500 for determining a valid key touch in an induction cooking system according to an exemplary embodiment of the present disclosure. At step 502, method 500 can include supplying energy to an induction heating coil. At step 504, method 500 can include energizing the induction heating coil to generate an electromagnetic induced signal having noise. At step 506, method 500 can include conducting the electromagnetic induced signal having noise to a user interface by user contact with the user interface and a cooking utensil associated with the induction heating coil. The induced signal can flow from the cooking utensil to the user interface through the user. At 508, method 500 can include detecting data indicative of a first key touch at the user interface. The data can include the electromagnetic induced signal having noise. At step 510, method 500 can include determining whether the first key touch is a valid key touch. At step 512, method 500 can include performing a predetermined function in response to the valid key touch.

Figure 9:
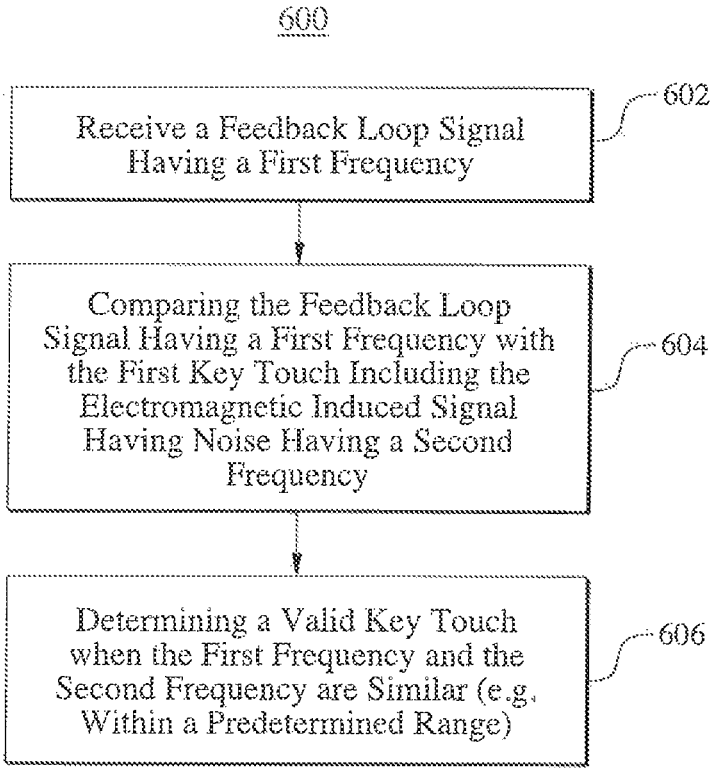
FIG. 9 provides a flow chart of a method for determining a valid key touch according to an exemplary embodiment of the present disclosure.

FIG. 9 depicts a flow chart of a method 600 for determining a valid key touch in an induction cooking system according to an exemplary embodiment of the present disclosure. At 602, method 600 can include receiving a feedback loop signal having a first frequency. At step 604, method 600 can include comparing the feedback loop signal having a first frequency with the first key touch including the electromagnetic induced signal having noise having a second frequency. At 606, method 600 can include determining a valid key touch when the first frequency and the second frequency are similar. For instance, the first and second frequencies are similar when they are within a predetermined range relative to each other.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of determining a valid key touch in an induction cooking system, comprising:

supplying energy to an induction heating coil;

energizing the induction heating coil to generate an electromagnetic induced signal having noise;

conducting the electromagnetic induced signal having noise to a user interface by user contact with the user interface and a cooking utensil associated with the induction heating coil, such that the induced signal flows from the cooking utensil to the user interface through the user;

detecting data indicative of a first key touch at the user interface, the data including the electromagnetic induced signal having noise; and determining whether the first key touch is a valid key touch.

2. The method, as in claim 1, further comprising:

performing a predetermined function in response to the valid key touch.

3. The method, as in claim 1, wherein determining the valid key touch step includes:

receiving a feedback loop signal having a first frequency;

comparing the feedback loop signal having a first frequency with the first key touch including the electromagnetic induced signal having noise having a second frequency;

determining a valid key touch when the first frequency and the second frequency are similar.

4. The method, as in claim 3, wherein the feedback loop signal is from at least one of a system controller feedback loop, an inverter feedback look, and an induction feedback loop.

5. The method as in claim 3, wherein the first and second frequencies are similar when they are within a predetermined range.

6. The method, as in claim 5, wherein the feedback loop signal is from at least one of a system controller feedback loop, an inverter feedback look, and an induction feedback loop.

7. The method, as in claim 1, wherein the user interface includes a capacitive touch sensitive display.

* * * * *